US006415859B1

(12) United States Patent
Kametani et al.

(10) Patent No.: US 6,415,859 B1
(45) Date of Patent: Jul. 9, 2002

(54) DEHUMIDIFICATION/HUMIDIFICATION AIR SUPPLY APPARATUS

(75) Inventors: Keiichiro Kametani; Shigehito Ota, both of Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/554,264

(22) PCT Filed: Nov. 10, 1998

(86) PCT No.: PCT/JP98/05037

§ 371 (c)(1),
(2), (4) Date: May 12, 2000

(87) PCT Pub. No.: WO99/24763

PCT Pub. Date: May 20, 1999

(30) Foreign Application Priority Data

Nov. 12, 1997 (JP) ..... 9-310877

(51) Int. Cl.[7] ..... F24F 3/14; F24F 3/147

(52) U.S. Cl. ..... 165/229; 165/228; 165/7; 62/271

(58) Field of Search ..... 165/66, 222, 223, 165/228, 229, 4, 6, 7, 8; 62/90, 271

(56) References Cited

U.S. PATENT DOCUMENTS

| | | | | |
|---|---|---|---|---|
| 3,446,031 A | | 5/1969 | Chi et al. | |
| 4,113,004 A | * | 9/1978 | Rush et al. | 165/7 X |
| 5,003,961 A | * | 4/1991 | Besik | 165/4 X |
| 5,179,998 A | * | 1/1993 | Des Champs | 165/66 X |
| 5,564,281 A | | 10/1996 | Calton et al. | 62/90 |
| 5,653,115 A | * | 8/1997 | Brickley et al. | 165/4 X |
| 5,709,736 A | | 1/1998 | Fujimura | |
| 5,826,641 A | * | 10/1998 | Bierwirth et al. | 165/66 X |
| 5,843,213 A | | 12/1998 | Fujimura | |
| 6,131,653 A | * | 10/2000 | Larsson | 165/227 X |
| 6,186,407 B1 | * | 2/2001 | Hammer et al. | 165/222 X |
| 6,199,392 B1 | * | 3/2001 | Maeda | 165/6 X |
| 6,209,622 B1 | * | 4/2001 | Lagace et al. | 165/8 |

FOREIGN PATENT DOCUMENTS

| | | |
|---|---|---|
| GB | 1551647 | 8/1979 |
| JP | 1-61924 | 4/1989 |
| JP | 5-346253 | 12/1993 |
| JP | 8-61729 | 3/1996 |
| JP | 8-145406 | 6/1996 |
| JP | 8-210664 | 8/1996 |
| JP | 9-126493 | 5/1997 |
| JP | 11-57383 | 3/1999 |

* cited by examiner

*Primary Examiner*—Ljiljana Ciric
(74) *Attorney, Agent, or Firm*—Wenderoth, Lind & Ponack, L.L.P.

(57) ABSTRACT

A dehumidified/humidified air supply apparatus includes two sets of air passages including heating units disposed at an upstream side thereof, a dehumidifying/humidifying unit having two portions disposed at a downstream side thereof and a blower. When dehumidified air is supplied by the dehumidifying/humidifying unit of the first air passage, the dehumidifying/humidifying unit is dehumidified by air which is heated by the heating unit of the second air passage. When humidified air is supplied by the heating unit of the first air passage and the dehumidifying/humidifying unit, the dehumidifying/humidifying unit is humidified by air of the second air passage. The dehumidifying/humidifying unit is moved between the first air passage and the second air passage by a driving unit.

11 Claims, 7 Drawing Sheets

HONEY-COMB STRUCTURE

DEHUMIDIFICATION/HUMIDIFICATION AIR SUPPLY APPARATUS

TECHNICAL FIELD

The present invention relates to a dehumidified/humidified air supply apparatus for keeping the inside of a semiconductor production apparatus, etc., at a fixed humidity.

BACKGROUND ART

In order to dehumidify the inside of a semiconductor production apparatus or the like, it has been hitherto adopted that a refrigerating machine is installed directly to a semiconductor production apparatus. The refrigerating machine cools the inside air to a targeted dew point to liquefy and remove moisture from the air, and then circulate the air in the semiconductor production apparatus. The refrigerating machine contains a compressor, a condenser, an evaporator, etc. and thus it has a vibration problem. Further, the condenser needs means for radiating heat to the outside and its construction is complicated. A heat exchanger and an electric heater are required to adjust the humidity of the inside of the semiconductor production apparatus. In addition, means for discharging water which is liquefied and removed for dehumidification and means for supplying water for humidification are needed.

An object of the present invention is to supply a dehumidified/humidified air supply apparatus which is designed in a simple construction, produces little vibration and needs neither supply nor discharge of liquid water.

DISCLOSURE OF INVENTION

The present invention provides a dehumidified/humidified air supply apparatus comprising: first and second air passages A, B including heaters 5, 6 disposed at an upstream side thereof, dehumidifier/humidifier 10 having two portions 10*a*, 10*b* disposed at a downstream side thereof and a blower 2; driver 17 for moving the dehumidifier/humidifier 10 between the two portions 10*a*, 10*b*, connected to the first air passage A carry out moisture desorption to supply humidified air, and the other portion 10*b* of the dehumidifier/humidifier 10 is subjected to moisture absorption by the air of the second air passage B.

According to the invention, when the air of the first air passage A is heated by the heater 5 at the upstream side of the dehumidifier/humidifier 10, moisture is supplied from the dehumidifier/humidifier 10 into the air, which means that humidified air is supplied in the first air passage A while the moisture absorption is carried out by the dehumidified dehumidifier/humidifier 10 in the second air passage B. On the other hand, when the air of the first air passage A is not heated by the heater 5 at the upstream side of the dehumidifier/humidifier 10, the dehumidifier/humidifier 10 absorbs the moisture in the air, which means the supply of dehumidified air in the first air passage A and also the dehumidification of the dehumidifier/humidifier 10 in the second air passage B by actuating the heater 6 of the second air passage B. The dehumidifier/humidifier 10 is moved between the portion 10*a* connected to the first air passage A and the portion 10*b* connected to the second air passage B, by the driver 17.

When the dehumidified air is supplied by the dehumidifier/humidifier 10 as described above, the moisture is removed by the air heated by the heater 6 of the second air passage B, so that no liquid water occurs. When the humidified air is supplied by the dehumidifier/humidifier 10, the moisture is supplied from the second air passage B, so that it is required to supply liquid water. Further, the invention can be achieved with a simple construction containing only the heaters 5, 6 such as an electric heater, the dehumidifier/humidifier 10 and the blower 2, and induce little vibration.

Further, the invention is characterized in that the dehumidified/humidified air supply apparatus is installed to a semiconductor production apparatus having humidity detector 30 therein provided, the semiconductor production apparatus being connected to the first air passage A, through which the air in the semiconductor production apparatus is circulated; and a controller 31 for actuating the heater 5 of the first air passage A and stopping the heater 6 of the second air passage B, when humidity of an inside of the semiconductor production apparatus is lower than a target humidity, and stopping the heater 5 of the first air passage A and actuating the heater 6 of the second air passage B, when the humidity of the inside of the semiconductor production apparatus is higher than the target humidity.

According to the invention, the humidity detector such as a dew point instrument 30 is provided in the semiconductor production apparatus. The air in the semiconductor production apparatus is circulated through the first air passage A. Further, the controller is provided to control as follows. When the humidity of the inside of the semiconductor production apparatus is lower than the target humidity, that is, humidification is needed, the heater 5 of the first air passage A is actuated and the heater 6 of the second air passage B is stopped. Thereby, moisture is supplied from the dehumidifier/humidifier 10 to the first air passage A. Accordingly, humidified air is supplied to the semiconductor production apparatus, while the air in the second air passage B is dehumidified by the dehumidifier/humidifier 10 because the heater 6 is not stopped. Conversely, when the humidity of the inside of the semiconductor production apparatus is higher than the target humidity, that is, dehumidification is needed, the heater 5 of the first air passage A is stopped and the heater 6 of the second air passage B is actuated, thereby the dehumidifier/humidifier 10 absorbs the moisture in the air of the first air passage A, which means the supply of dehumidified air to the semiconductor production apparatus and also the dehumidification of the dehumidifier/humidifier 10 in the second air passage B by actuating the heater 6 of the second air passage B. The dehumidifier/humidifier 10 is moved between the portion 10*a* connected to the first air passage A and the portion 10*b* connected to the second air passage B, by the driver 17.

When the dehumidified air is supplied to the semiconductor production apparatus by the dehumidifier/humidifier 10 as described above, the moisture is removed by the air heated by the heater 6 of the second air passage B, so that no liquid water occurs. When the humidified air is supplied to the semiconductor production apparatus by the dehumidifier/humidifier 10, the moisture is supplied from the second air passage B, so that it is required to supply liquid water. Further, the invention can be achieved with a simple construction containing only the heaters 5, 6 such as a electric heater, the dehumidifier/humidifier 10 and the blower 2, and the air in the semiconductor production apparatus is controlled to have the target humidity without inducing significant vibration.

Further, the invention is characterized in that the controller calculates a difference between the humidity of the inside of the semiconductor production apparatus and the target humidity, and in the case where the difference is equal to or less than a predetermined value, controls the heater 5 of the first air passage A or the heater 6 of the second air passage B to operate with a power proportional to the difference.

According to the invention, the controller calculates the difference between the humidity of the inside of the semiconductor production apparatus and the target humidity, and controls the heater 5, 6 of the first air passage A or the second air passage B to operate with a power proportional to the difference when the difference is equal to or lower than the predetermined value, whereby the humidity of the inside of the semiconductor production apparatus is prevented from hunting around the target humidity and it is quickly set to the target humidity. When the difference exceeds the predetermined value, the heater operates with its one hundred percent power.

Further, the invention is characterized in that when the humidity of the inside of the semiconductor production apparatus is lower than the target humidity, the controller calculates a difference between the target humidity and the humidity of the inside of the semiconductor production apparatus, and in the case where the difference is equal to or greater than a predetermined value, the controller controls the air amount of the second air passage B to increase.

According to the invention, when the inside of the semiconductor production apparatus is humidified, the difference between the target humidity and the humidity of the inside of the semiconductor production apparatus is calculated. When the difference is equal to or more than the predetermined value, the amount of the air in the second air passage B is increased. In winter season, the inside of the semiconductor production apparatus is more frequently humidified, and the absolute humidity of the outside air is normally low in winter season. Therefore, when the difference is particularly large, the humidity of the inside of the semiconductor production apparatus can be quickly set to the target humidity by increasing the amount of the air in the second air passage.

Further, the invention is characterized in that the dehumidifier/humidifier includes: a dehumidifying rotor 10 consisting of a substantially cylindrical base member carrying dehumidifying agent thereon, the dehumidifying rotor 10 having a plurality of air passage holes which are designed in a honey-comb structure in an axial direction thereof; a driver 17 for rotating the dehumidifying rotor 10 around a longitudinal axis thereof; and a partition plate 9 which divides the dehumidifying rotor 10 into a first portion 10*a* and a second portion 10*b* in a peripheral direction thereof at both ends of the dehumidifying rotor 10 in the axial direction, wherein the first air passage A is connected to the first portion 10*a* while the second air passage B being connected to the second portion 10*b*.

According to the invention, the dehumidifier/humidifier has the dehumidifying rotor 10 having a substantially cylindrical overall shape, and the dehumidifying rotor 10 is divided into the first portion 10*a* and the second portion 10*b* by the partition plate 9. The first air passage A is connected to the first portion 10*a* while the second air passage B is connected to the second portion 10*b*. The dehumidifying rotor 10 is rotated around the axis thereof by the driver 17, so that the it is moved from the first portion 10*a* to the second portion 10*b* or from the second portion 10*b* to the first portion 10*a*. Accordingly, when the dehumidification is carried out in the first portion 10*a* and the dehumidified air is supplied from the first air passage A, the dehumidifying rotor 10 at the first portion 10*a* gradually absorbs moisture and moves to the second portion 10*b*. At the second portion 10*b*, the moisture of the dehumidifying rotor 10 is gradually described by the heated air in the second air passage B. Under the state that the dehumidifying rotor 10 is sufficiently dehumidified, it is moved to the first portion 10*a* again. When the humidification is carried out in the first portion 10*a*, the moisture of the dehumidifying rotor 10 at the first portion 10*a* is gradually described by the heated air, and moves to the second portion 10*b*. At the second portion 10*b*, the dehumidifying rotor absorbs the moisture of the non-heated air of the second air passage B, and moves to the first portion 10*a* again under the state that it sufficiently absorbs the moisture. As described above, uniform dehumidified/humidified air is continuously supplied by the substantially cylindrical dehumidifying rotor 10.

Further, the invention is characterized in that the first air passage A and the second air passage B are connected so as to make parallel flow in the dehumidifying rotor 10.

According to the invention, the first air passage A and the second air passage B are connected to the dehumidifying rotor 10 so as to make parallel flow. Accordingly, the blower 2 can be used commonly to the first air passage A and the second air passage B, and the heater 5 of the first air passage A and the heater 6 of the second air passage B can be disposed so as to be adjacent to each other, so that the construction can be simplified.

Further, the invention is characterized in that the first air passage A and the second air passage B are connected so as to make counter flow in the dehumidifying rotor 10.

According to the invention, the first air passage A and the second air passage B are connected to the dehumidifying rotor 10 so as to make the counter flow. Accordingly, the entrance of the second air passage B at which the regeneration of the dehumidifying rotor 10 is most carried out becomes the exit of the first air passage A, and the dehumidification/humidification efficiency can be enhanced.

Further, the invention is characterized in that cooler 21 is provided at the downstream side of the dehumidifier/humidifier 10 connected to the first air passage A.

According to the invention, the cooler 21 is provided at the downstream side of the dehumidifier/humidifier 10 connected to the first air passage A. When the moisture in the air is adsorbed by an adsorpter such as the dehumidifying rotor 10, an exothermic action is induced. When the moisture adsorbed by the dehumidifying rotor 10 is described, an endothermic action is induced. However, since the heater such as the electric heater 5 is provided at the upstream side of the dehumidifier/humidifier such as the dehumidifying rotor 10, the temperature at the exit of the dehumidifying/humidifying apparatus 1 becomes higher than the temperature at the entrance thereof. In order to make the temperature at the exit of the dehumidifying/humidifying apparatus 1 of the first air passage A equal to the temperature at the entrance thereof, the cooler 21 is provided at the downstream side of the dehumidifying rotor 10 connected to the first air passage A. The cooler 21 merely reduces the temperature of the circulated air of the first air passage A, and thus a Peltier cooler which is compact and produces little vibration is preferably used as the cooler.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
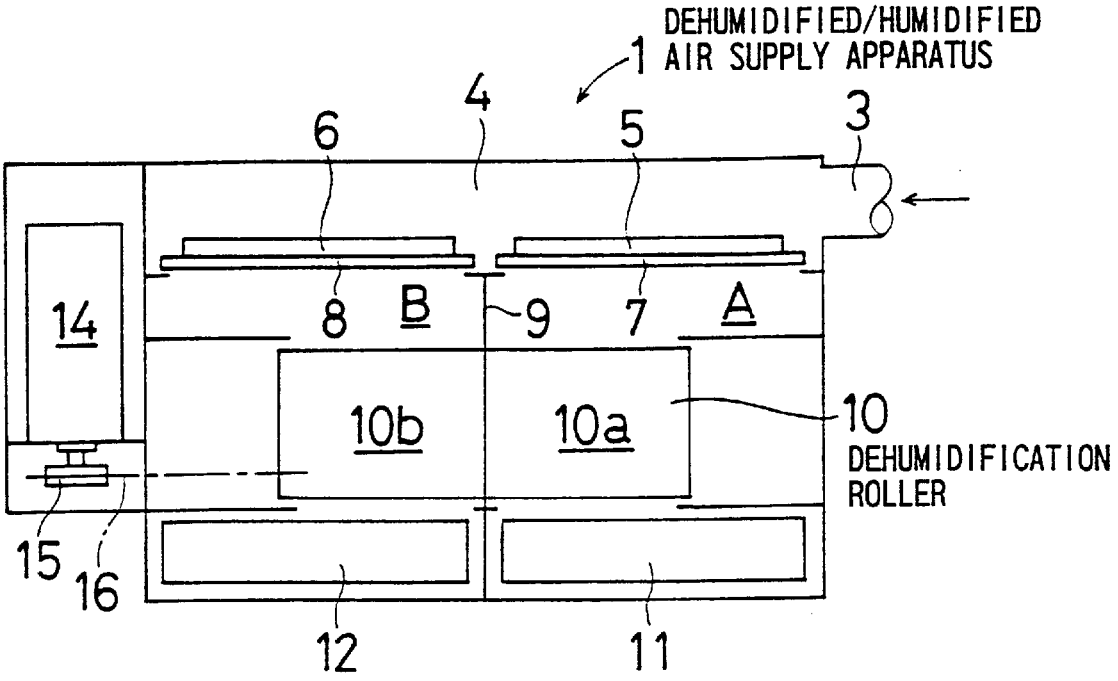
FIG. 1 is a side view showing a dehumidified/humidified air supply apparatus 1 according to a first embodiment of the invention.

Now referring to the drawings, preferred embodiments of the invention are described below.

Figure 2:
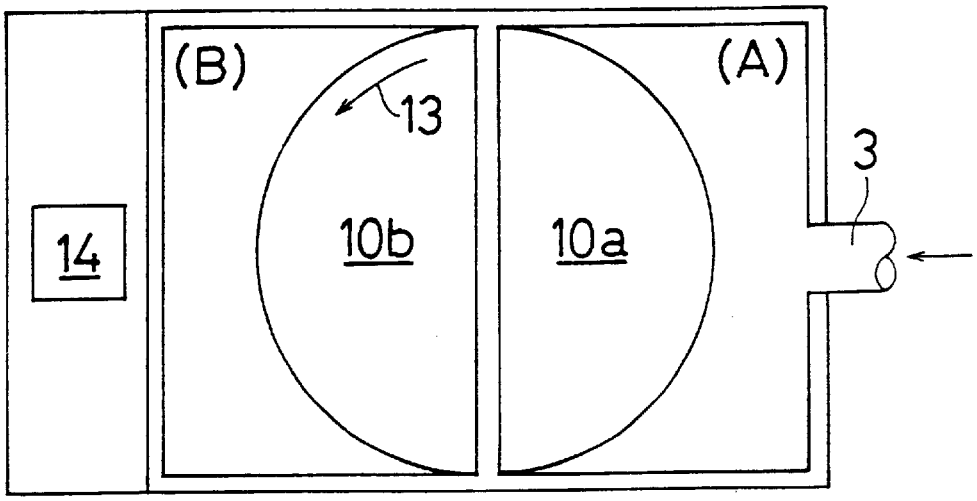
FIG. 2 is a plan view showing the dehumidified/humidified air supply apparatus 1.
Figure 3:
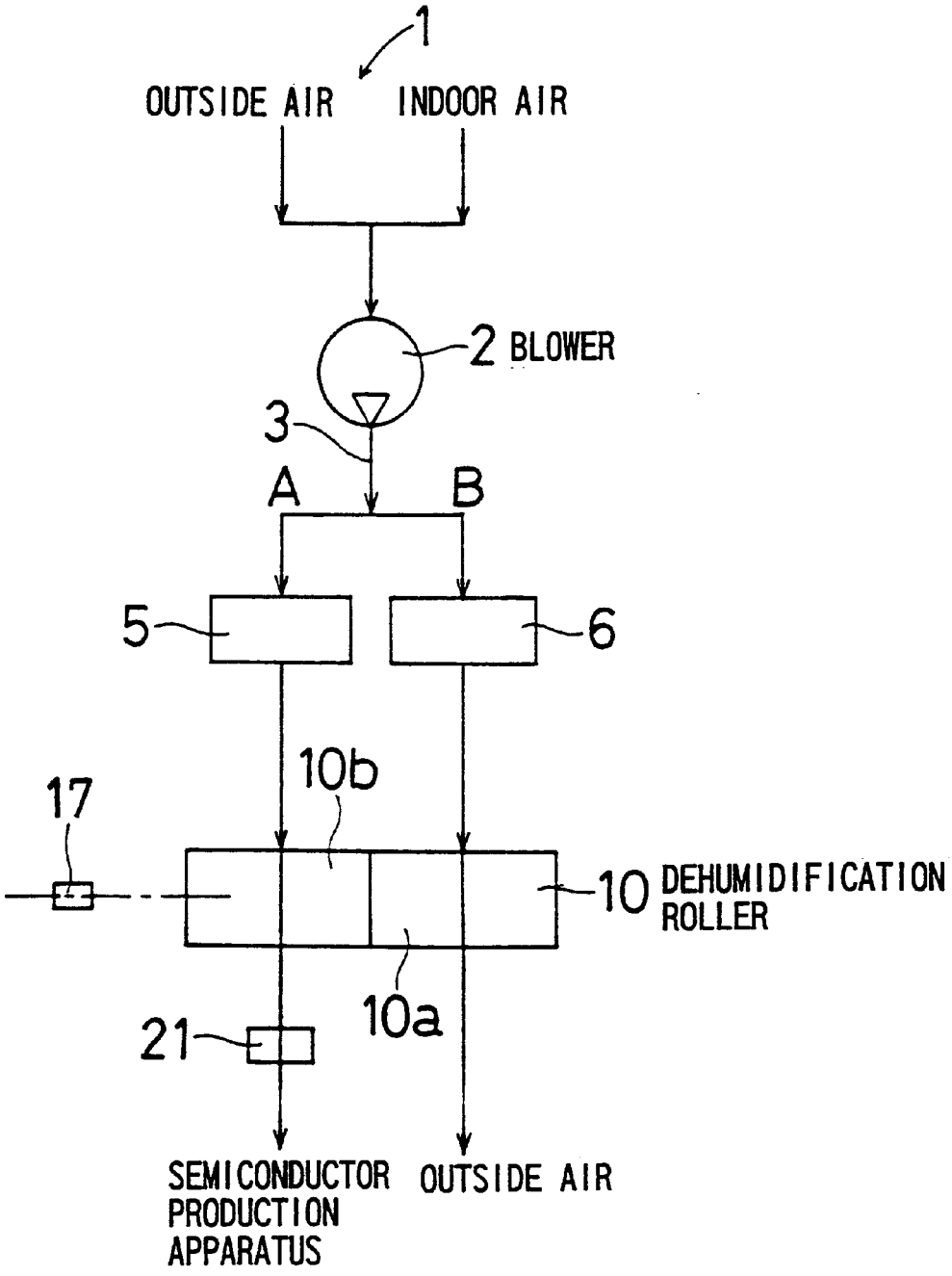
FIG. 3 is a systematic diagram showing the dehumidified/humidified air supply apparatus 1.

FIG. 1 is a side view showing the internal construction of a dehumidified/humidified air supply apparatus 1 of an embodiment of the present invention, and FIG. 2 is a plan view and FIG. 3 is a systematic diagram thereof The air in a semiconductor production apparatus which partially contains outside air is passed from a blower 2 to a pipe line 3 and then fed into the apparatus 1. The upper portion of the apparatus 1 serves as a header 4, and is divided into a first air passage A and a second air passage B. The two air passages A, B are separated from each other by a partition plate 9, and connected through electric heaters 5, 6 to a first portion 10*a* and a second portion 10*b* of a dehumidifying rotor 10, respectively. Dehumidified/humidified air is guided from the first portion 10*a* of the dehumidifying rotor 10 to a supply port 11. The supply port 11 is open to the inside of the semiconductor production apparatus. The second air passage B is guided from the second portion 10*b* of the dehumidifying rotor 10 to a discharge port 12 and discharged to the outside air.

Figure 4:
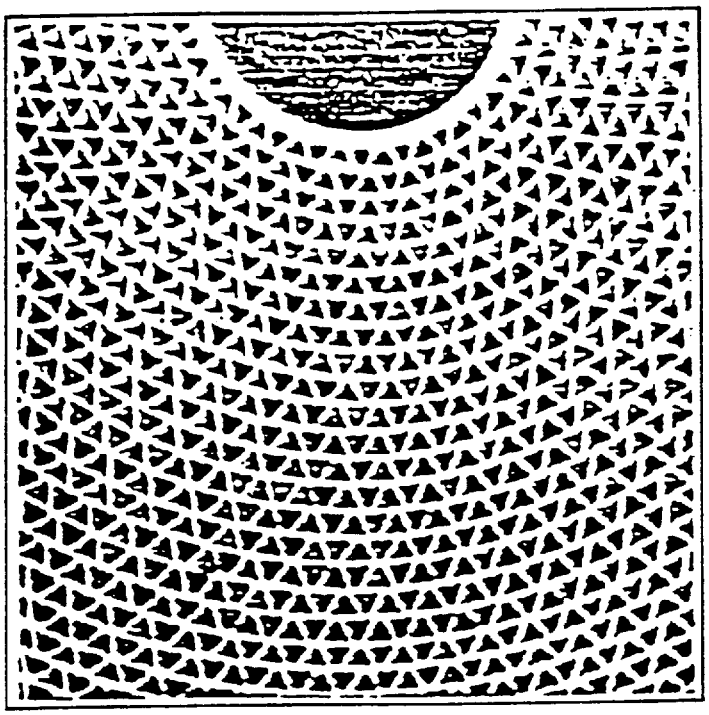
FIG. 4 is a partially enlarged front view of a dehumidifying rotor 10.

FIG. 4 is a partially enlarged view showing the dehumidifying rotor 10. The dehumidifying rotor 10 has a substantially cylindrical shape as a whole, is composed of a base member carrying dehumidifying agent thereon and has a plurality of gas permeable holes which are designed in a honey-comb structure so as to extend in the axial direction. The dehumidifying rotor 10 may be an activated carbon rotor obtained by impregnating lithium chloride into laminated activated carbon paper, for example, or a silica gel rotor obtained by chemically synthetically coupling silica gel to ceramic fiber paper. When air having high relative humidity is fed to the dehumidifying rotor 10, the moisture of the air is adsorbed by the dehumidifying rotor 10. When air of high temperature is fed, the moisture adsorbed by the dehumidifying rotor 10 is described. The dehumidifying rotor 10 is provided with a driver 17, and the dehumidifying rotor 10 is slowly rotated in the direction as indicated by an arrow 13. The dehumidifying rotor 10 which is humidified or dehumidified by the air of the first air passage A at the first portion 10*a* of the dehumidifying rotor 10 is moved to the second portion, and dehumidified or humidified by the air of the second air passage B.

Figure 5:
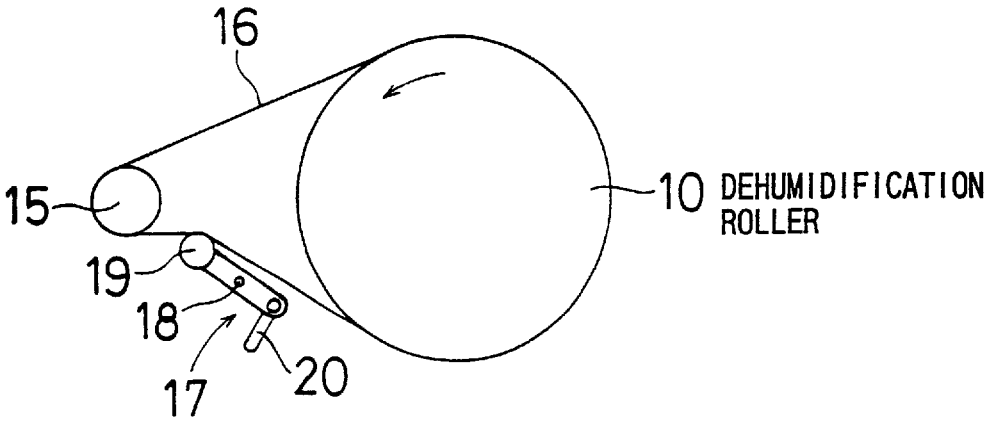
FIG. 5 is a plan view showing an example of a driving apparatus 17 of the dehumidifying rotor 10.

FIG. 5 is a plan view showing an example of the a driver 17 of the dehumidifying rotor 10. The driver 17 comprises a driving motor 14, a pulley 15 which is directly linked to the driving motor 14, a belt 16 which is stretched between the pulley 15 and the dehumidifying rotor 10, and tension adjuster. The tension adjuster has a supporting point 18 at the center thereof, and it is provided with a tension pulley 19 at one end portion thereof and with a spring 20 at the other end portion thereof, whereby suitable tension is applied to the belt 16 and the driving force of the pulley 15 is transmitted to the dehumidifying rotor 10.

For example, when the inside of the semiconductor production apparatus is dehumidified, air of 26° C. and 50%RH (absolute humidity: 10.5 g/kg') is fed to the first air passage A, and then it is supplied as air having absolute humidity of 4.8 g/kg' from the supply port 11 into the semiconductor production apparatus. In the second air passage B, the same air is heated up to 75° C. and fed to the dehumidifying rotor 10 to dehumidify the dehumidifying rotor 10, and then air of 52° C. and absolute humidity of 16.2 g/kg' is discharged from the discharge port 12.

When the inside of the semiconductor production apparatus is humidified, in the first air passage A, air of 20° C. and 40%RH (absolute humidity of 5.8 g/kg') is heated up to 70° C. and fed to the dehumidifying rotor 10 to be converted to humidified air having absolute humidity of 8.9 g/kg', and then supplied from the air supply port 11 into the semiconductor production apparatus. In the second air passage B, the same air is fed to the dehumidifying rotor 10 to give the moisture to the dehumidifying rotor 10, and air having absolute humidity of 2.7 g/kg' is discharged from the discharge port 12.

A Peltier cooler 21 is provided at the downstream side of the dehumidifying rotor 10 of the first air passage A to cool the air of the first air passage A which is increased in temperature while it is passed through the apparatus 1 so that the temperature thereof is equal to the temperature at the entrance of the apparatus 1.

Figure 6:
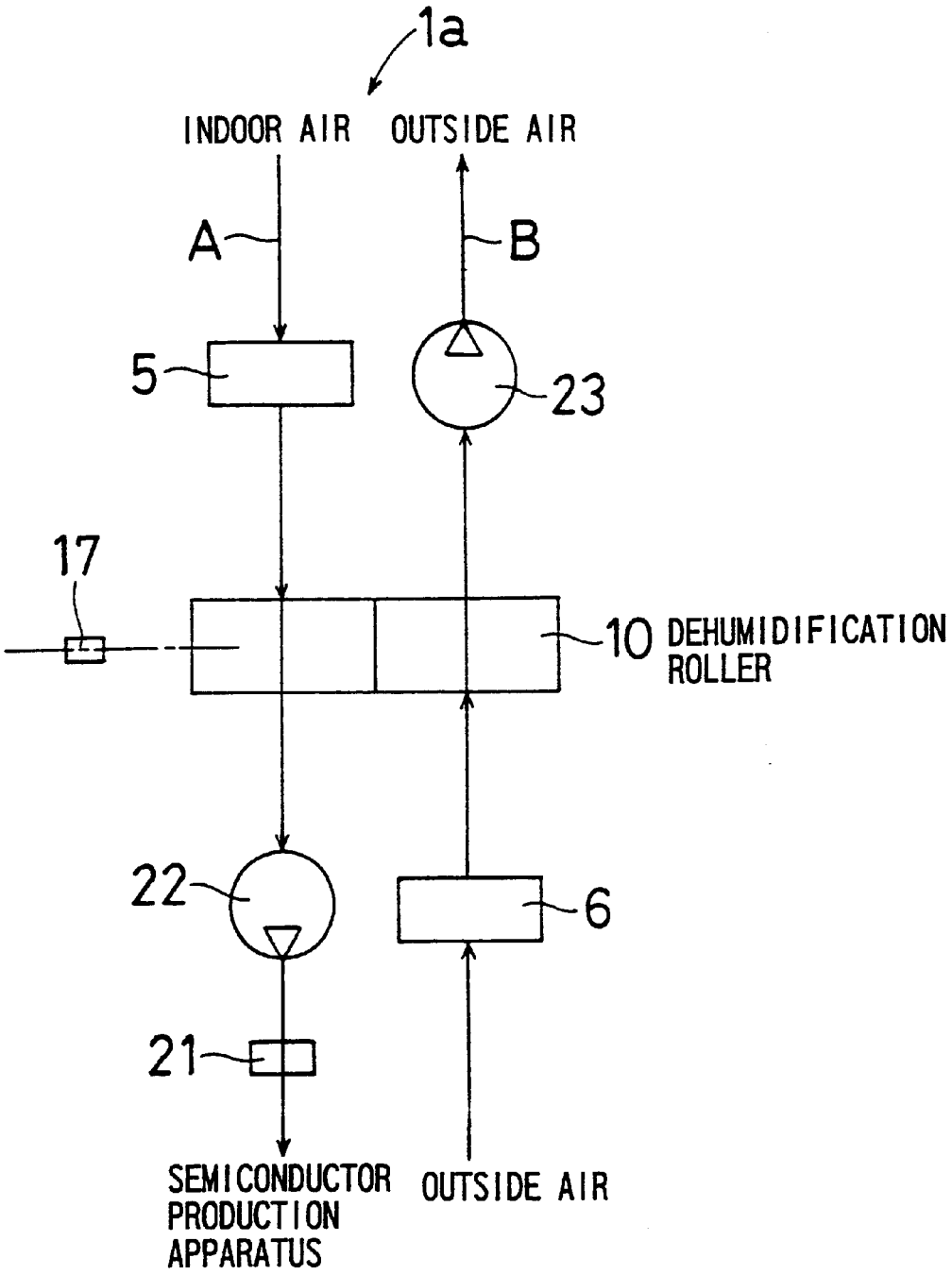
FIG. 6 is a systematic diagram showing a dehumidified/humidified air supply apparatus 1*a* of a second embodiment of the invention.

FIG. 6 is a systematic diagram showing a dehumidified/humidified air supply apparatus 1*a* of a second embodiment of the invention. The apparatus 1*a* has a similar construction to the apparatus 1, and the same elements are represented by the same reference numerals. In the apparatus 1, the air of the first air passage A and the air of the second air passage B make parallel flow to the dehumidifying rotor 10. However, in the apparatus 1*a*, they make counter flow. Further, blowers 22, 23 are separately provided to the air passages A, B, respectively. The establishment of the counter flow to the dehumidifying rotor 10 between the first air passage A and the second air passage B provides a higher dehumidification/humidification efficiency, however, the construction thereof is more complicated because the heaters 5, 6 are positionally far away from each other and the two blowers 22, 23 are provided. Further, the blowers 22, 23 are separately provided to the air passages A, B respectively, so that the air in the semiconductor production apparatus is perfectly circulated. In the case where it is required to ventilate a part of the air in the semiconductor production apparatus, the outside air is slightly mixed into the first air passage A. In this case, the pressure of the inside of the semiconductor production apparatus is positive, and cleaning air leaks from the gap to the outside.

Figure 7:
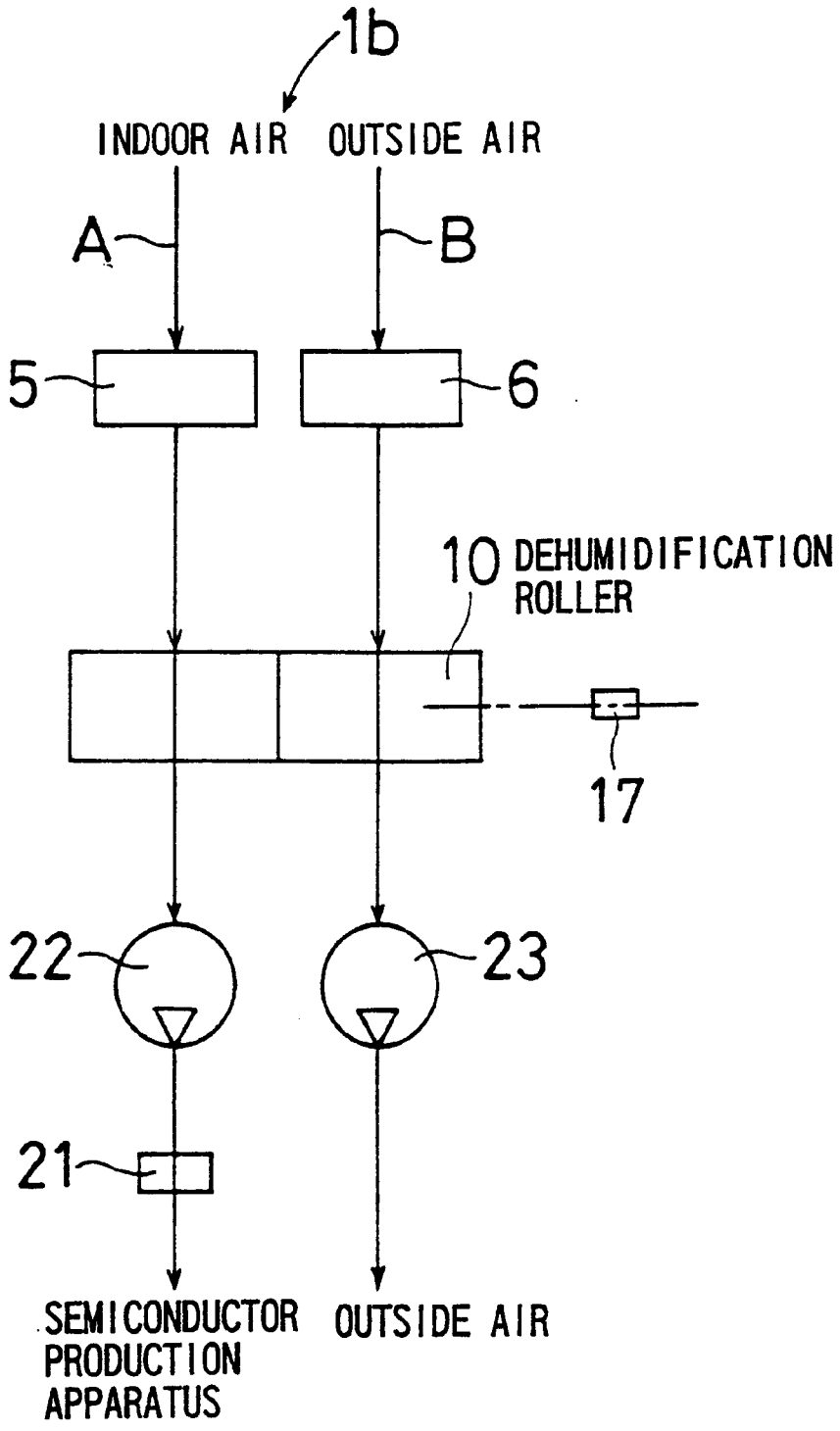
FIG. 7 is a systematic diagram showing a dehumidified/dehumidified air supply apparatus 1*b* of a third embodiment of the invention.

FIG. 7 is a systematic diagram showing a dehumidified/humidified air supply apparatus 1*b* of a third embodiment of the invention. The apparatus 1*b* also has a similar construction to the apparatuses 1, 1*a*, and the same elements are represented by the same reference numerals. In the apparatus 1, the air is fed to the first air passage A and the second air passage B by one blower 2. In the apparatus 1*b*, the air is separately fed by two blowers 22, 23. Provision of two blowers 22, 23 enables the air in the semiconductor production apparatus to be independently circulated. In the case where it is required to ventilate the air in the semiconductor production apparatus, the outside air is slightly mixed into the first air passage.

There may be considered a dehumidifying/humidifying apparatus for feeding the air of the first air passage and the air of the second air passage to the dehumidifying rotor in the counter flow style by using one blower. However, it is not practically used because each air passage is complicated.

Figure 8:
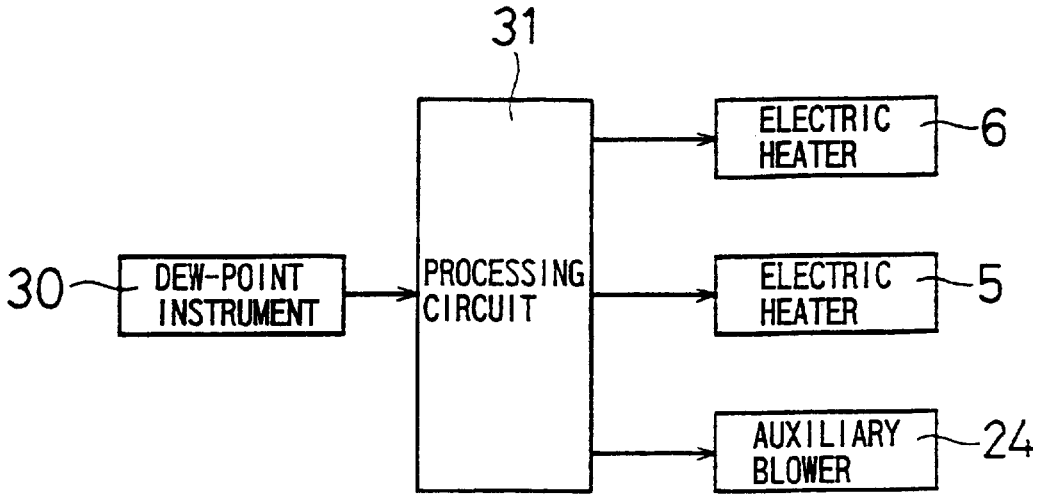
FIG. 8 is a block diagram showing the electrical construction of the dehumidified/humidified air supply apparatus 1 of the invention.

FIG. 8 is a block diagram showing the electrical construction of the apparatuses 1, 1*a*, 1*b*. Humidity detector, for example, a dew-point instrument 30 is provided in the semiconductor production apparatus. A plurality of dew-point instruments 30 are provided, and the average value thereof may be calculated. A processing circuit 31 which is implemented by a microcomputer or the like compares the output of the dew-point instrument 30 with a target dew point t° C. set by the processing circuit 31. When the output of the dew-point instrument 30 (actual dew point) is higher than the target dew point t° C., the electrical heater 6 of the second air passage B is actuated while the electrical heater 5 is not actuated. Accordingly, the air of the first air passage A is dehumidified by the dehumidifying rotor 10, and the dew point of the dew-point instrument 30 is gradually reduced. When the dew point of the dew-point instrument 30 is lower than the target dew point t° C., the electrical heater 6 is stopped by the processing circuit 31, and the electrical heater 5 is actuated. In the case where each of the electrical heaters 5, 6 is subjected to on-off control by the processing circuit, there occurs such a hunting phenomenon that each of the electrical heaters 5, 6 is frequently turned on and off when the dew point in the semiconductor production apparatus approaches to the target dew point t° C. and this is unfavorable. Therefore, it is set that both the electrical heaters 5, 6 are not actuated in the range of t±1° C. Under this control, the dew point is not controlled in the range from t−1° C. to t+1° C., and thus precise control cannot be performed.

On the other hand, when the difference between the target dew point t° C. and the dew point of the dew-point instrument 30 is within a predetermined range, for example, 5° C. or less, the electrical heater 5 or 6 is actuated in proportion to the difference between the target dew point t° C. and the dew point of the dew-point instrument 30. For example, the electrical heater 5 or 6 is actuated by 100% when the difference between the target dew point t° C. and the output of the dew-point instrument is equal to 5° C. or more; by 80% when the difference is equal to 4° C.; by 60% when the difference is equal to 3° C.; by 40% when the difference is equal to 2° C.; and by 20% when the difference is equal to 1° C., whereby the humidity of the inside of the semiconductor production apparatus can be precisely controlled.

Figure 9:
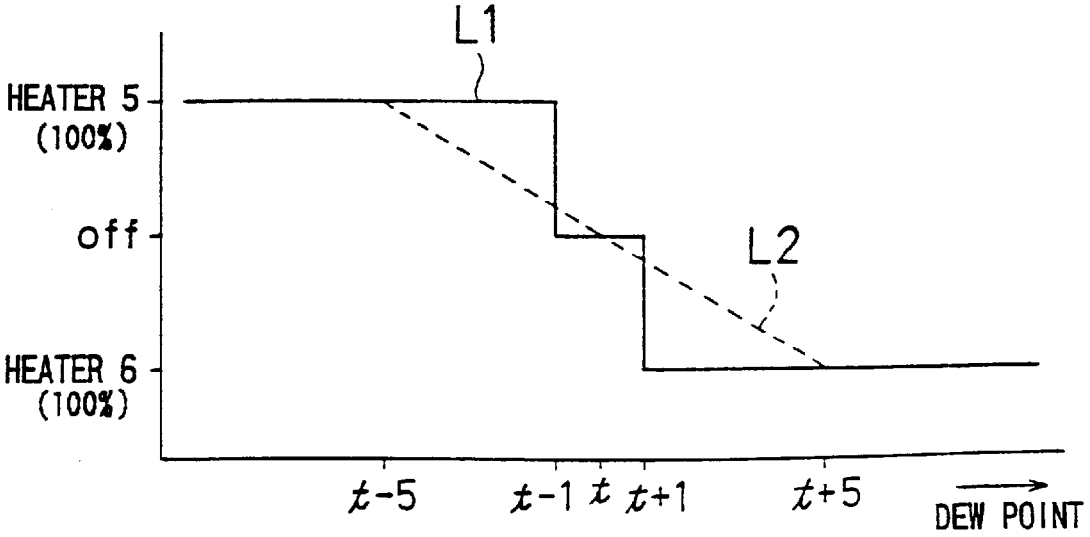
FIG. 9 is a chart showing the relationship between the operation status of electric heaters 5, 6 and the dew point.

A line L1 of FIG. 9 represents the operation status of the electrical heaters 5, 6 under on-off control, and a line L2 represents the operation status of the electrical heaters 5, 6 under proportional control.

Figure 10:
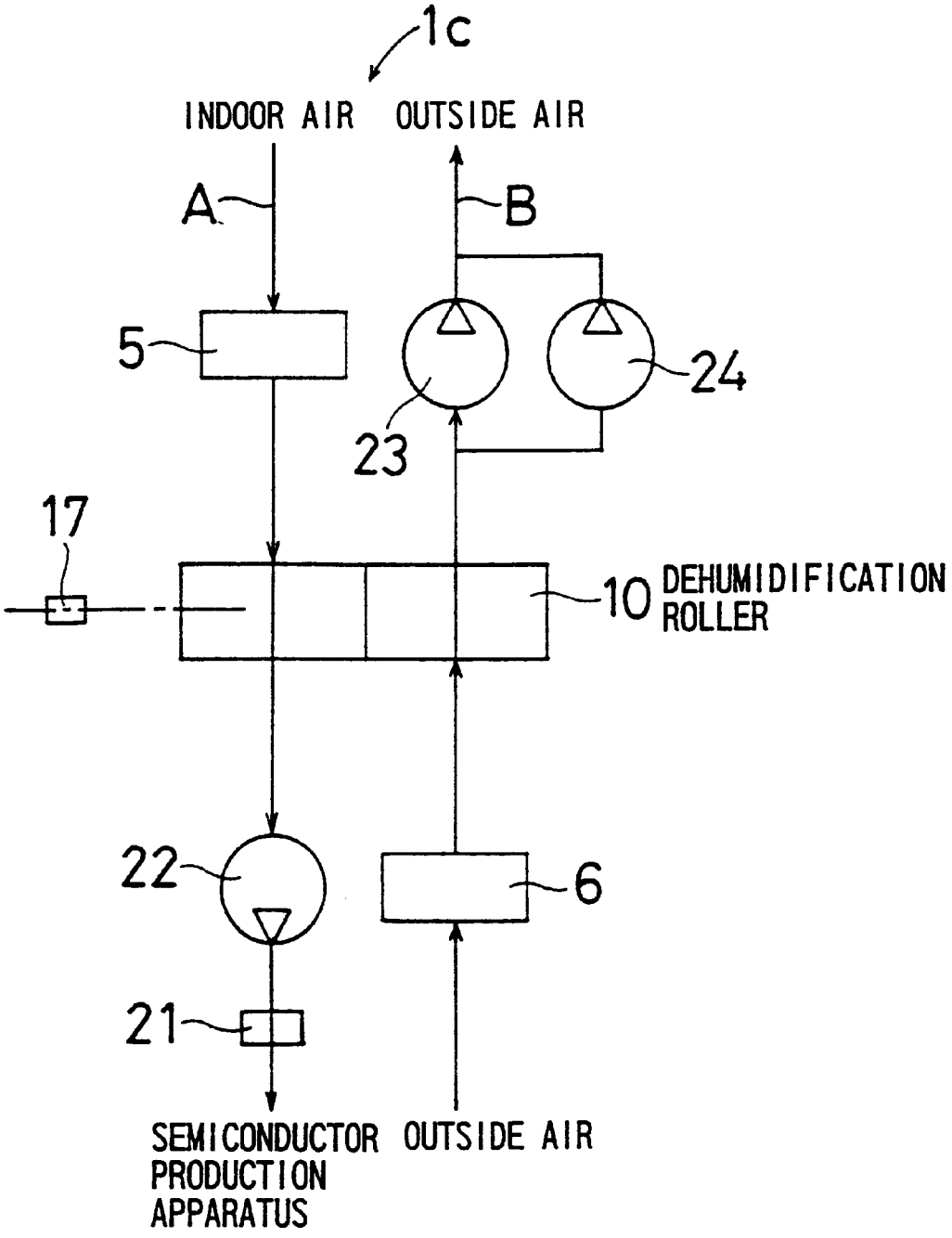
FIG. 10 is a systematic diagram showing a dehumidified/humidified air supply apparatus 1*c* of a fourth embodiment of the invention.

FIG. 10 is a systematic diagram showing a dehumidified/humidified air supply apparatus 1*c* of a fourth embodiment of the invention. The apparatus 1*c* has a similar construction to the apparatus 1*a* of the second embodiment, and the same elements are represented by the same reference numerals. In the apparatus 1*c*, an auxiliary blower 24 is provided to the second air passage B in parallel to the blower 23. In the case where the apparatus 1*c* is used as a humidified air supply apparatus, for example when the air supplied to the second air passage B is 5° C. and 40%RH (absolute humidity of 2.1 g/kg'), under such a condition that the outside temperature is low and the absolute humidity is low in winter season or the like, it would be impossible to increase the absolute humidity of the air of the first air passage A by 3 g/kg' if the first air passage A and the second air passage B have the same air amount. In this case, the auxiliary blower 24 of the second air passage B is actuated to increase the air amount of the second air passage B. The operation of the auxiliary blower 24 is also carried out by the processing circuit 31 shown in FIG. 8. As a method of increasing the air amount of the second air passage B, the rotational number of the blower 23 may be increased in place of use of the auxiliary blower 24. This embodiment may be applied to the third embodiment shown in FIG. 7.

The invention may be embodied in other specific forms without departing from the spirit or essential characteristics thereof The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL UTILITY

As described above, according to the invention, the dehumidified/humidified air is supplied by the first air passage A, and the dehumidifying rotor 10 serving as the dehumidifier/humidifier is regenerated by the second air passage B. Therefore, the dehumidified/humidified air can be obtained without supplying/discharging water as liquid. Further, the air in the semiconductor production apparatus is not required to be cooled to the dew point or less by the refrigerating machine. Therefore, it is unnecessary to directly install the refrigerating machine into the semiconductor production apparatus to which the dehumidified/humidified air is to be supplied, no vibration is applied to the semiconductor production apparatus, and the construction can be simplified by the dehumidifying rotor 10, the electrical heaters 5, 6 and the blower 2.

What is claimed is:

1. A dehumidified/humidified air supply apparatus for use with a semiconductor production apparatus having a humidity detector that detects humidity inside of the semiconductor production apparatus, said dehumidified/humidified air supply apparatus comprising:

a first air passage that passes a first portion of air;

a second air passage that passes a second portion of air;

a blower that blows air into said first air passage or said second air passage;

a first heater disposed so as to heat the first portion of air;

a second heater disposed so as to heat the second portion of air;

a dehumidifier/humidifier having two portions, said dehumidifier/humidifier comprising a dehumidifying/humidifying device and being disposed so as to receive the first portion of air that has been heated by said first heater and the second portion of air that has been heated by said second heater;

a driver for moving said dehumidifying/humidifying device; and a controller, operably connected to said first heater and to said second heater, said controller being for actuating said first heater and for stopping said second heater when humidity inside of the semiconductor production apparatus is lower than a target humidity, and for stopping said first heater and for actuating said second heater when the humidity inside of the semiconductor production apparatus is higher than the target humidity, wherein said first air passage is arranged so as to circulate air in the semiconductor production apparatus, wherein said driver and said dehumidifying/humidifying device are arranged such that said driver is capable of moving said dehumidifying/humidifying device between a first position and a second position, wherein when said dehumidifying/humidifying device is in the first position, a first portion of said dehumidifying/humidifying device is disposed within said first air passage and a second portion of said dehumidifying/humidifying device is disposed within said second air passage, and wherein when said dehumidifying/humidifying device is in the second position, the first portion of said dehumidifying/humidifying device is disposed within said second air passage and the second portion of said dehumidifying/humidifying device is disposed within said first air passage.

2. The dehumidified/humidified air supply apparatus of claim 1, wherein said controller is operable to calculate a difference between the humidity of the inside of the semiconductor production apparatus and the target humidity, and wherein said controller is operable to control said first heater or said second heater to operate in proportion to the difference, when the difference is equal to or less than a predetermined value.

3. The dehumidified/humidified air supply apparatus of claim 1, wherein said controller is operable to calculate a difference between the target humidity and the humidity of the inside of the semiconductor production apparatus, when the humidity of the inside of the semiconductor production apparatus is lower than the target humidity, and wherein said controller is operable to increase the amount of air in the second air passage when the difference is equal to or greater than a predetermined value.

4. The dehumidified/humidified air supply apparatus of claim 1, wherein said dehumidifying/humidifying device comprises a dehumidifying rotor comprising a substantially cylindrical base member carrying a dehumidifying agent, said dehumidifying rotor having a plurality of air passage holes which are designed in a honey-comb structure in an axial direction of said dehumidifying rotor, wherein said dehumidifier/humidifier further comprises a partition plate that divides the dehumidifying rotor into a first portion and a second portion, wherein said driver is operable to rotate the dehumidifying rotor around a longitudinal axis of said cylindrical base member, wherein said first portion is disposed so as to contact said first portion of air, and wherein said second portion is disposed so as to contact said second portion of air.

5. The dehumidified/humidified air supply apparatus of claim 4, wherein said first air passage and said second air passage are arranged so as to enable air to flow in a first direction through said dehumidifying rotor.

6. The dehumidified/humidified air supply apparatus of claim 4, wherein said first air passage is arranged so as to enable air to flow in a first direction through said dehumidifying rotor, and wherein and said second air passage is arranged so as to enable air to flow in a second direction through said dehumidifying rotor.

7. The dehumidified/humidified air supply apparatus of claim 4, wherein said first portion and said second portion are semicircular.

8. The dehumidified/humidified air supply apparatus of claim 1, further comprising a cooler, wherein said cooler is disposed at position such that said dehumidifier/humidifier is disposed between said cooler and said first heater, and wherein said cooler is disposed so as to cool the first portion of air.

9. A system comprising:

said dehumidified/humidified air supply apparatus of claim 1; and a semiconductor production apparatus having a humidity detector that detects humidity inside of the semiconductor production apparatus, wherein said humidity detector is disposed within said semiconductor production apparatus.

10. A dehumidified/humidified air supply apparatus for use with a semiconductor production apparatus having a humidity detector that detects humidity inside of the semiconductor production apparatus, said dehumidified/humidified air supply apparatus comprising:

a first air passage that passes a first portion of air;

a second air passages that passes a second portion of air;

a first heater being disposed so as to heat the first portion of air;

a second heater being disposed so as to heat the second portion of air;

a dehumidifier/humidifier having two portions, said dehumidifier/humidifier comprising a dehumidifying/humidifying device and being disposed so as to receive the first portion of air that has been heated by said first heater and the second portion of air that has been heated by said second heater;

a driver for moving said dehumidifying/humidifying device; and a controller, operably connected to said first heater and to said second heater, said controller being for actuating said first heater and for stopping said second heater when humidity inside of the semiconductor production apparatus is lower than a target humidity, and for stopping said first heater and for actuating said second heater when the humidity inside of the semiconductor production apparatus is higher than the target humidity.

11. A dehumidified/humidified air supply apparatus for use with a semiconductor production apparatus having a humidity detector that detects humidity inside of the semiconductor production apparatus, said dehumidified/humidified air supply apparatus comprising:

a first air passage that passes a first portion of air;

a second air passages that passes a second portion of air;

a blower that blows air into said first air passage and said second air passage;

a first heater being disposed so as to heat the first portion of air;

a second heater being disposed so as to heat the second portion of air;

a dehumidifier/humidifier having two portions, said dehumidifier/humidifier comprising a dehumidifying/humidifying device and being disposed so as to receive the first portion of air that has been heated by said first heater and the second portion of air that has been heated by said second heater;

a driver for moving said dehumidifying/humidifying device; and a controller, operably connected to said first heater and to said second heater, said controller being for actuating said first heater and for stopping said second heater when humidity inside of the semiconductor production apparatus is lower than a target humidity, and for stopping said first heater and for actuating said second heater when the humidity inside of the semiconductor production apparatus is higher than the target humidity.

* * * * *